US007766687B2

(12) United States Patent
Verjans et al.

(10) Patent No.: US 7,766,687 B2
(45) Date of Patent: Aug. 3, 2010

(54) CONNECTOR HAVING DIFFERENT SIZE RECESSES

(75) Inventors: Conrad Wilhelmus Adriaan Verjans, Landgraaf (NL); Dietrich Bertram, Aachen (DE)

(73) Assignee: Koninklijke Philips Electronics N V, Eindhoven (NL)

( * ) Notice: Subject to any disclaimer, the term of this patent is extended or adjusted under 35 U.S.C. 154(b) by 0 days.

(21) Appl. No.: 12/298,142

(22) PCT Filed: Apr. 19, 2007

(86) PCT No.: PCT/IB2007/051419

§ 371 (c)(1),
(2), (4) Date: Oct. 23, 2008

(87) PCT Pub. No.: WO2007/125463

PCT Pub. Date: Nov. 8, 2007

(65) Prior Publication Data

US 2009/0078445 A1 Mar. 26, 2009

(30) Foreign Application Priority Data

Apr. 28, 2006 (EP) ..... 06113262

(51) Int. Cl.
*H01R 4/24* (2006.01)

(52) U.S. Cl. ..... 439/404; 439/395

(58) Field of Classification Search ..... None
See application file for complete search history.

(56) References Cited

U.S. PATENT DOCUMENTS

| | | | | |
|---|---|---|---|---|
| 3,845,236 | A * | 10/1974 | Anderson | 174/88 R |
| 4,138,184 | A * | 2/1979 | Knopp | 439/399 |
| 4,153,326 | A * | 5/1979 | Frantz et al. | 439/293 |
| 4,508,399 | A * | 4/1985 | Dowling et al. | 439/67 |
| 5,338,220 | A * | 8/1994 | Soes et al. | 439/403 |
| 5,709,566 | A | 1/1998 | Tsuji et al. | |
| 5,944,463 | A | 8/1999 | Savage, Jr. | |
| 6,863,558 | B2 * | 3/2005 | Negishi et al. | 439/404 |
| 2003/0056969 | A1 * | 3/2003 | Eves et al. | 174/68.1 |
| 2005/0063181 | A1 | 3/2005 | Chiba et al. | |

FOREIGN PATENT DOCUMENTS

| | | |
|---|---|---|
| EP | 0470887 A1 | 2/1992 |
| GB | 2409332 A | 6/2005 |

* cited by examiner

*Primary Examiner*—Michael C Zarroli

(57) ABSTRACT

A connector connects first electrodes of circuits to pair of cables having different sizes, such as different sized conductors or different sized insulators around same sized conductors. The connector has two parts connected by a hinge. The two parts include recesses that form two different sized openings in a closed position of the connector, for receiving the different sized cables in a non-interchangeable way. Forks or pins of different sizes stick out from the recesses for contacting the conductors of the cables.

9 Claims, 2 Drawing Sheets

CONNECTOR HAVING DIFFERENT SIZE RECESSES

Figure 1:
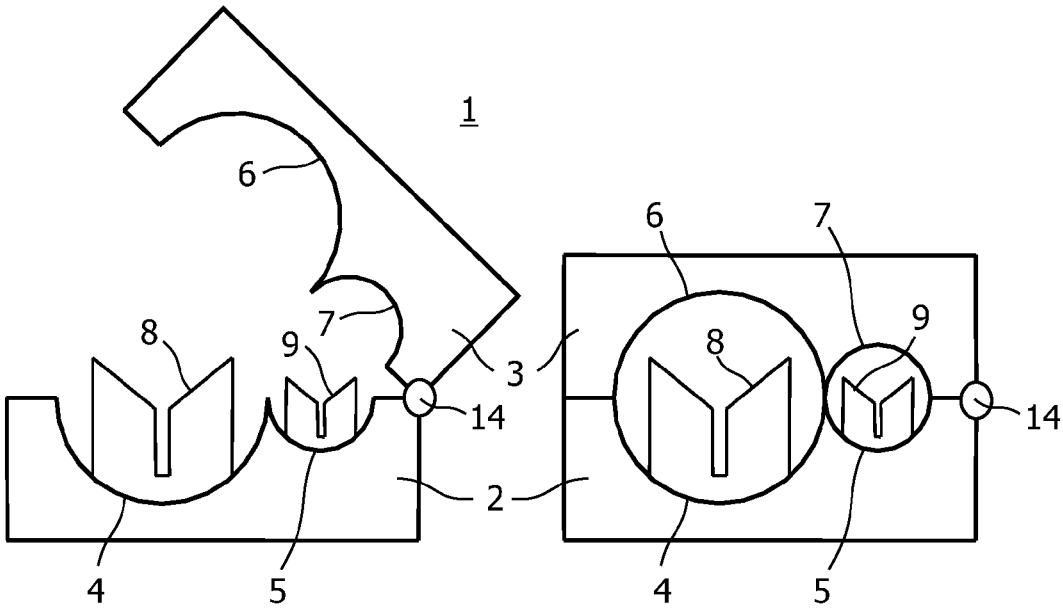

The invention relates to a snap-on connector, and also relates to a circuit, to a device, to a cable and to a method.

Examples of such a circuit are circuits that need to be connected to a power supply, and examples of such a device are consumer products and non-consumer products. The device may comprise a power supply or not.

A prior art snap-on connector is known from GB 2 409 332, which discloses a snap-on connector that is connected, on the one hand, via an interface to a lamp and, on the other hand, to two wires.

Certain circuits require a DC voltage/current instead of an AC voltage/current. Those circuits that require a DC voltage/current usually comprise two electrodes that are to be connected to the two wires in a non-interchangeable way. One of the electrodes is considered to be a positive electrode or a ground electrode, and the other electrode is considered to be a ground electrode or a negative electrode.

To avoid that the circuit is damaged in case of its electrodes being connected to the two wires in an interchanged way, the prior art snap-on connector might be provided with an additional protection diode. In case the electrodes are connected to the two wires in an incorrect (interchanged) way, only a small current flows through the protection diode. This current is that small that the circuit cannot be damaged. In case of the electrodes being connected to the two wires in a correct (non-interchanged) way, only a small voltage will be present across the protection diode. This voltage is so small that the circuit can operate as usual.

The prior art snap-on connector is disadvantageous, inter alia, in that it requires an additional protection diode to protect the circuit from being damaged in case of its electrodes being connected to the two wires in an incorrect (interchanged) way. Such an additional protection diode increases the costs, the volume and the complexity of the connector and/or of the circuit and is responsible for voltage losses and additional power consumption.

It is an object of the invention, inter alia, to provide a snap-on connector for connecting electrodes of a circuit to wires that reduces a chance that the electrodes of the circuit and the wires can be connected in an incorrect (interchanged) way.

Further objects of the invention are, inter alia, to provide a circuit comprising a connector, to provide a device comprising a circuit, to provide a cable and to provide a method that reduce a chance that the electrodes of the circuit and the wires can be connected in an incorrect (interchanged) way.

A snap-on connector according to the invention connects a first electrode of a circuit to a first electrical element having a first element size and connects a second electrode of the circuit to a second electrical element having a second element size that is smaller than the first element size and comprises a first recess for guiding the first electrical element and comprises a second recess for guiding the second electrical element, the respective first and second recesses comprising respective first and second means for pairing the first recess and the first electrical element and for pairing the second recess and the second electrical element in a non-interchangeable way.

By using different electrical elements having different element sizes and by introducing recesses comprising different means for pairing each one recess and each one electrical element in a non-interchangeable way, a chance that the electrodes of the circuit and the wires can be connected in an incorrect (interchanged) way is reduced.

The snap-on connector according to the invention is further advantageous, inter alia, in that an additional protection diode is avoided.

An embodiment of the snap-on connector according to the invention is defined by the first means being a first recess size and the second means being a second recess size that is smaller than the first recess size. By giving the different recesses different sizes, it is visually clear which one of the electrical elements belongs to which one of the recesses.

An embodiment of the snap-on connector according to the invention is defined by the first and second electrical elements being parallel electrical elements, the first and second element sizes being sizes in a plane parallel to a cross-section of the electrical elements and the first and second recess sizes being sizes in the plane. These first and second electrical elements are for example electrical wires that form part of a cable.

An embodiment of the snap-on connector according to the invention is defined by the first and second element sizes being diameters and the first recess comprising a first curved shape and the second recess comprising a second curved shape and the first recess size being a diameter of the first shape and the second recess size being a diameter of the second shape. In an ideal situation, cross-sections of the wires are circles and cross-sections of the recesses are parts of circles. A diameter of a curved shape is a diameter of a circle or is an average diameter of a non-circle.

An embodiment of the snap-on connector according to the invention is defined by a difference between the first recess size and the second electrical element size being larger than a difference between the first recess size and the first electrical element size and a difference between the second recess size and the first electrical element size being larger than a difference between the second recess size and the second electrical element size. By introducing these differences, it is visually more clear which one of the electrical elements belongs to which one of the recesses.

An embodiment of the snap-on connector according to the invention is defined by comprising first and second parts, the first part comprising the first and second recesses and the second part comprising third and fourth recesses, the first and third recesses together forming a first opening for fixing the first electrical element and the second and fourth recesses together forming a second opening for fixing the second electrical element in a closed position of the first and second parts. The openings fix the wires in a closed position of the first and second parts. In an open position of the first and second parts, the wires can be placed and/or removed.

An embodiment of the snap-on connector according to the invention is defined by comprising a hinge for coupling the first and second parts to each other. The hinge increases a user-friendliness of the snap-on connector.

An embodiment of the snap-on connector according to the invention is defined by the hinge being located closer to the second and fourth recesses than to the first and third recesses. By locating the smaller recesses closer to the hinge, the snap-on connector cannot be closed in case the larger electrical element is put into the smaller recess.

An embodiment of the snap-on connector according to the invention is defined by comprising a first contact sticking out from the first recess and pointing to the third recess and comprising a second contact sticking out from the second recess and pointing to the fourth recess in the closed position of the first and second parts. These first and second contacts may be pins or forks or other kinds of contacts.

An embodiment of the snap-on connector according to the invention is defined by the first electrical element comprising a first conductor and the second electrical element comprising a second conductor, the first element size being a diameter of the first conductor and the second element size being a diameter of the second conductor. In this case the conductors such as the cores of the wires have different diameters. At least between these conductors, an isolation layer may be present.

An embodiment of the snap-on connector according to the invention is defined by the first electrical element comprising a first conductor surrounded by a first isolation layer and the second electrical element comprising a second conductor surrounded by a second isolation layer, the first element size being a diameter of a combination of the first conductor and the first isolation layer and the second element size being a diameter of a combination of the second conductor and the second isolation layer. In this case the wires each including a conductor such as the core of the wire and including an isolation layer such as the outer surface of the wire have different diameters. This might be realized by giving the conductors different diameters and by giving the layers the same thickness.

An embodiment of the snap-on connector according to the invention is defined by a diameter of the first conductor being substantially equal to a diameter of the second conductor and a thickness of the first isolation layer being larger than a thickness of the second isolation layer. In this case the conductors have similar diameters and the isolation layers have different thicknesses. The similar diameters of the conductors will be responsible for similar impedance values of the conductors.

An embodiment of the snap-on connector according to the invention is defined by the first means comprising a first contact sticking out from the first recess and the second means comprising a second contact sticking out from the second recess, the first contact comprising a first contact size and the second contact comprising a second contact size that is smaller than the first contact size. These first and second contacts may be pins or forks or other kinds of contacts. By introducing smaller pins/forks and larger pins/forks, whereby the smaller pins/forks are destined to penetrate/surround/cut the smaller wire and the larger pins/forks are designed to penetrate/surround/cut the larger wire, even in case it is visually not clear which one of the electrical elements belongs to which one of the recesses, a chance that the electrodes of the circuit and the wires can be connected in an incorrect (interchanged) way is reduced.

The circuit according to the invention comprises the snap-on connector according to the invention. Embodiments of the circuit according to the invention correspond with the embodiments of the snap-on connector according to the invention.

An embodiment of the circuit according to the invention is defined by comprising one or more light emitting diodes. These light emitting diodes may be organic or anorganic light emitting diodes or other kinds of light emitting diodes. Other kinds of circuits such as transistor circuits are however not to be excluded.

Embodiments of the device according to the invention and of the cable according to the invention and of the method according to the invention correspond with the embodiments of the snap-on connector according to the invention.

The invention is based on the insight, inter alia, that an additional protection diode can be avoided by reducing a chance that the electrodes of the circuit and the wires are connected in an incorrect (interchanged) way, and is based on the basic idea, inter alia, that the different electrical elements should have different element sizes and the recesses should comprise different means for pairing each one recess and each one electrical element in a non-interchangeable way.

The invention solves the problem, inter alia, to provide a snap-on connector for connecting electrodes of a circuit to wires that reduces a chance that the electrodes of the circuit and the wires can be connected in an incorrect (interchanged) way. The snap-on connector is further advantageous, inter alia, in that an additional protection diode is avoided.

These and other aspects of the invention will be apparent from and elucidated with reference to the embodiments(s) described hereinafter.

Figure 2:
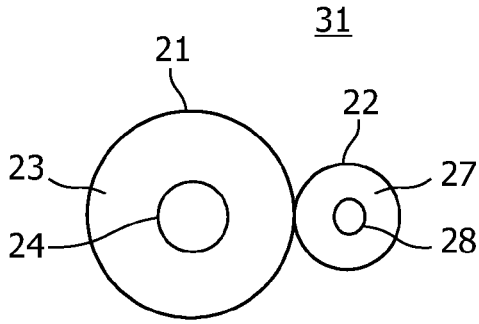
Figure 3:
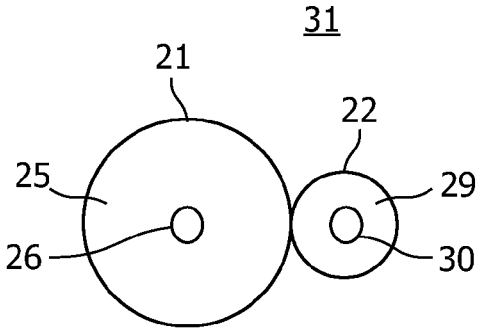
Figure 4:
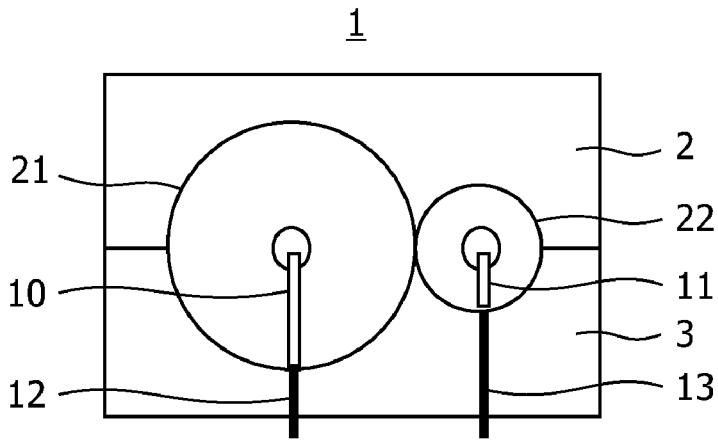
Figure 5:
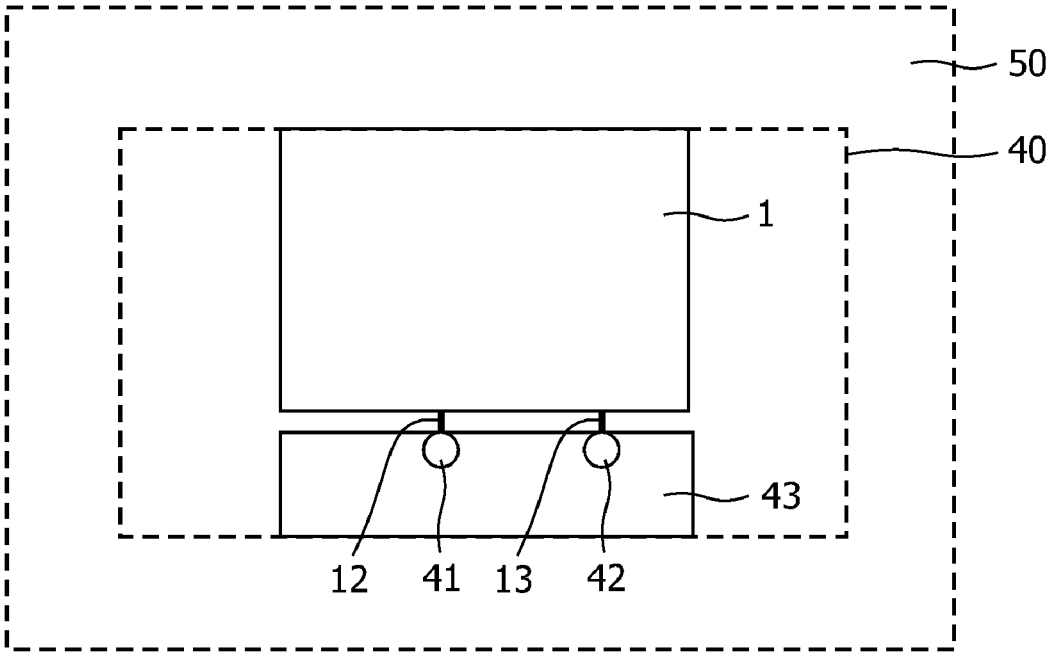

In the drawings:

FIG. 1 shows in cross-section a first embodiment of a snap-on connector according to the invention in an open position (left side) and a closed position (right side), FIG. 2 shows in cross-section a first embodiment of a cable according to the invention, FIG. 3 shows in cross-section a second embodiment of a cable according to the invention, FIG. 4 shows in cross-section a second embodiment of a snap-on connector according to the invention in a closed position and comprising a cable according to the invention, and FIG. 5 shows a device according to the invention comprising a circuit according to the invention.

The first embodiment of the snap-on connector 1 according to the invention shown in the FIG. 1 in cross-section in an open position (left side) and a closed position (right side) comprises a first part 2 and a second part 3. The first part 2 comprises a first recess 4 and a second recess 5. The second part 3 comprises a third recess 6 and a fourth recess 7. The first and third recesses 4 and 6 together form a first opening for fixing a first electrical element 21 shown in the FIGS. 2 and 3 and the second and fourth recesses 5 and 7 together form a second opening for fixing a second electrical element 22 shown in the FIGS. 2 and 3 in a closed position of the first and second parts 2 and 3.

A first contact 8 in the form of a first fork is sticking out from the first recess 4 and is pointing towards the third recess 6 and a second contact 9 in the form of a second fork is sticking out from the second recess 5 and is pointing towards the fourth recess 7 in the closed position of the first and second parts 1 and 2. A hinge 14 couples the first and second parts 2 and 3 and allows these first and second parts 2 and 3 to be opened and closed.

The first embodiment of the cable 31 according to the invention shown in the FIG. 2 in cross-section comprises the first electrical element 21 and the second electrical element 22. The first electrical element 21 comprises a first conductor 24 surrounded by a first isolation layer 23 and the second electrical element 22 comprises a second conductor 28 surrounded by a second isolation layer 27.

The second embodiment of the cable 31 according to the invention shown in the FIG. 3 in cross-section comprises the first electrical element 21 and the second electrical element 22. The first electrical element 21 comprises a first conductor 26 surrounded by a first isolation layer 25 and the second electrical element 22 comprises a second conductor 30 surrounded by a second isolation layer 29.

The second embodiment of the snap-on connector 1 according to the invention shown in the FIG. 4 in a closed position and comprising the cable 31 according to the invention corresponds with the first embodiment of the snap-on connector 1 shown in the FIG. 1 apart from the fact that another first contact 10 in the form of a first pin is sticking out from the first recess 4 and is pointing towards the third recess 6 and another second contact 11 in the form of a second pin is sticking out from the second recess 5 and is pointing towards the fourth recess 7 in the closed position of the first and second parts 1 and 2, whereby the hinge 14 may be present or not. Further, connections 12 and 13 connect the contacts 10 and 11 to the outside of the snap-on connector 1.

The device 50 according to the invention shown in the FIG. 5 comprises the circuit 40 according to the invention. The circuit 40 comprises for example one or more organic or anorganic light emitting diodes 43. The connections 12 and 13 of the snap-on connector 1 are connected to first and second electrodes 41 and 42 of the circuit 40 (or of the one or more organic or anorganic light emitting diodes 43).

The snap-on connector 1 connects the first electrode 41 of the circuit 40 shown in the FIG. 5 to the first electrical element 21 having a first element size and connects the second electrode 42 of the circuit 40 to the second electrical element 22 having a second element size that is smaller than the first element size. The snap-on connector 1 thereto comprises the first recess 4 for guiding the first electrical element 21 and comprises the second recess 5 for guiding the second electrical element 22. The respective first and second recesses 4 and 5 thereto comprise respective first and second means for pairing, on the one hand, the first recess 4 and the first electrical element 21 and, on the other hand, the second recess 5 and the second electrical element 22 in a non-interchangeable way.

According to a first possibility, the first means are a first recess size and the second means are a second recess size that is smaller than the first recess size. In that case, the first and second electrical elements 21 and 22 may be parallel electrical elements, whereby the first and second element sizes may be sizes in a plane parallel to a cross-section of the electrical elements 21 and 22 and the first and second recess sizes may be sizes in the plane. The first and second element sizes may be diameters and the first recess 4 may have a first curved shape such as a shape of half a first circle and the second recess 5 may have a second curved shape such as a shape of half a second circle and the first recess size may be a diameter of the first circle and the second recess size may be a diameter of the second circle.

A difference between the first recess size and the second electrical element size might preferably be larger than a difference between the first recess size and the first electrical element size and a difference between the second recess size and the first electrical element size might preferably be larger than a difference between the second recess size and the second electrical element size.

For this first possibility, the hinge 14 might preferably be located closer to the second and fourth recesses 5 and 7 than to the first and third recesses 4 and 6. The first element size may be a diameter of a combination of the first conductor 24 or 26 and the first isolation layer 23 or 25 and the second element size may be a diameter of a combination of the second conductor 28 or 30 and the second isolation layer 27 or 29. A diameter of the first conductor 26 is preferably substantially equal to a diameter of the second conductor 30 and a thickness of the first isolation layer 25 is preferably larger than a thickness of the second isolation layer 29. Alternatively, the first electrical element 21 may comprise a first (flexible or non-flexible) conductor and the second electrical element 22 may comprise a second (flexible or non-flexible) conductor with for example an isolation layer being in between, in which case the first element size may be a diameter of the first conductor and the second element size may be a diameter of the second conductor.

According to a second possibility, the first means comprise a first contact 8 or 10 that is sticking out from the first recess 4 and the second means comprise a second contact 9 or 11 that is sticking out from the second recess 5, whereby the first contact 8 or 10 comprises a first contact size and the second contact 9 or 11 comprises a second contact size that is smaller than the first contact size. These contact sizes may comprise a length of a pin or a thickness of the pin or a length of a fork or a space between the legs of the fork etc.

The cable 31 comprises the first electrical element 21 having a first element size and comprises the second electrical element 22 having a second element size that is smaller than the first element size. These first and second electrical elements 21 and 22 are, in case of forming part of a cable, parallel electrical elements, whereby the first and second element sizes will be sizes in a plane parallel to a cross-section of the electrical elements 21 and 22.

Alternatively, a combination of a first electrical element 21 having a first element size and of a second electrical element having a second element size that is smaller than the first element size and of a snap-on connector 1 for connecting a first electrode 41 of a circuit 40 to the first electrical element 21 and for connecting a second electrode 42 of the circuit 40 to the second electrical element 22 may comprise a first recess 4 located in the snap-on connector 1 for guiding the first electrical element 21 and may comprise a second recess 5 located in the snap-on connector 1 for guiding the second electrical element 22, which respective first and second recesses 4 and 5 may comprise respective first and second means for pairing the first recess 4 and the first electrical element 21 and for pairing the second recess 5 and the second electrical element 22 in a non-interchangeable way. Of such a combination, the first and second electrical elements 21 and 22 on the one hand and the snap-on connector 1 on the other hand may be produced and/or sold separately.

Further alternatively, in the snap-on connector 1 according to the invention the first and second means comprise first and second sizes of the first and second recesses 4 and 5 and/or comprise first and second sizes of first and second recess parts such as first and second contacts 8,10 and 9,11. In other words, the respective first and second means are respective first and second sizes, with these first and second sizes being different sizes.

Each electrical element 21 or 22 may be a flexible element or a non-flexible element for transporting one or more electrical signals. These electrical signals may comprise one or more voltage signals and/or one or more current signals. These electrical signals may be constant during one or more time-intervals and/or may be changing during the one or more time-intervals.

Summarizing, a prior art low cost snap-on connector is commonly known. Its housing fits around a cable. A metal pin or fork can penetrate through the cable insulation to make an electrical connection. The advantage of such a snap-on connector is that it can be placed at each position of a cable, and that no mating part is needed. However, these prior art snap-on connectors can be mounted in two directions, and are thereby not applicable for poled applications. The OLED is a pole-sensitive component (as is the diode) and is thereby not suitable for this prior art snap-on connector.

If the cable diameters for a plus wire and a minus wire are different from each other, then a physical difference is created. If a snap-on connector housing is made with a large opening and a small opening, then the cable fits only according to one possibility. This can be used for a polarization. The combination of the wire and connector will make the system unique and easy to use. The cable can be mounted into a room (e.g. in the plinths). Afterwards the OLED can be positioned wherever it is needed and then the snap-on connector can be applied to the cable without preparation. Once the OLED is not needed any more the connector can be removed and the cable is still in tact. The fork-shape can be made safe for kids. The connector can also be used for other poled applications. It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. Use of the verb "to comprise" and its conjugations does not exclude the presence of elements or steps other than those stated in a claim. The article "a" or "an" preceding an element does not exclude the presence of a plurality of such elements. In the device claim enumerating several means, several of these means may be embodied by one and the same item of hardware. The mere fact that certain measures are recited in mutually different dependent claims does not indicate that a combination of these measures cannot be used to advantage.

The invention claimed is:

1. A connector for connecting a first electrode of a circuit to a first electrical element and for connecting a second electrode of the circuit to a second electrical element, wherein the first electrical element includes a first conductor surrounded by a first isolation layer and the second electrical element includes a second conductor surrounded by a second isolation layer, the second isolation layer being smaller than the first isolation layer, the connector comprising:

a first pair of recesses forming a first opening for receiving the first electrical element and a second pair of recesses forming a second opening for receiving the second electrical element, the second opening being smaller than the first opening so that the second opening and the first opening respectively receive first electrical element and the second electrical element in a non-interchangeable way;

a first contact extending from a recess of the first pair of recesses into the first opening for penetrating the first isolation layer and contacting the first conductor; and a second contact extending from a recess of the second pair of recesses into the second opening for penetrating the second isolation layer and contacting the second conductor;

wherein a length of the second contact is smaller than a length of the first contact.

2. The connector of claim 1, wherein the first electrical element is parallel to the second electrical element.

3. The connector of claim 1, wherein the first and second pairs of recesses are formed in two parts of the connector, the connector further comprising a hinge for coupling two parts to each other.

4. The connector of claim 3, wherein the hinge is located closer to the second opening than to the first opening.

5. The connector of claim 1, wherein a diameter of the first conductor is substantially equal to a diameter of the second conductor.

6. A circuit comprising the connector as defined in claim 1.

7. The circuit of claim 6, further comprising one or more light emitting diodes.

8. A device comprising the circuit of claim 6.

9. A method for connecting a first electrode of a circuit to a first electrical element and for connecting a second electrode of the circuit to a second electrical element via a connector, wherein the first electrical element includes a first conductor surrounded by a first isolation layer and the second electrical element includes a second conductor surrounded by a second isolation layer, the second isolation layer being smaller than the first isolation layer, the connector comprising a first a first pair of recesses forming a first opening for receiving the first electrical element; and a second pair of recesses forming a second opening for receiving the second electrical element, the second opening being smaller than the first opening, wherein the method comprises the act of:

receiving the first electrical element and the second electrical element in a non-interchangeable way in the first opening and the second opening respectively; and penetrating the first isolation with a first contact extending from a recess of the first pair of recesses into the first opening for contacting the first conductor, and penetrating the second isolation with a second contact extending from a recess of the second pair of recesses into the second opening for contacting the second conductor, wherein a length of the second contact is smaller than a length of the first contact.

* * * * *